US005486153A

United States Patent [19]

Gingras

[11] Patent Number: 5,486,153

[45] Date of Patent: Jan. 23, 1996

[54] EXTERNALLY ADJUSTABLE LIQUID INTERFACE FOR A CENTRIFUGAL SEPARATOR

[75] Inventor: Earl Gingras, Eckville, Canada

[73] Assignee: Gingras Separators Inc., Edmonton, Canada

[21] Appl. No.: 444,742

[22] Filed: May 19, 1995

[51] Int. Cl.[6] ..... B04B 11/00

[52] U.S. Cl. ..... 494/57

[58] Field of Search ..... 494/2, 3, 47, 48, 494/56, 57, 85, 901; 210/97, 109, 112, 115

[56] References Cited

U.S. PATENT DOCUMENTS

| | | | |
|---|---|---|---|
| 3,279,687 | 10/1966 | Amero | 494/56 X |
| 3,407,999 | 10/1968 | Kirkpatrick | 494/3 |
| 4,464,162 | 8/1984 | Cummings | 494/57 X |
| 5,090,953 | 2/1992 | Buttner et al. | 494/37 X |
| 5,405,307 | 4/1995 | Borgstrom et al. | 494/57 |

*Primary Examiner*—David Scherbel
*Assistant Examiner*—Charles E. Cooley
*Attorney, Agent, or Firm*—Anthony R. Lambert

[57] ABSTRACT

An externally adjustable liquid interface for a centrifugal separator. A tubular liquid outlet extends into a rotatably mounted drum. The tubular liquid outlet has an exterior surface, an interior bore, and a top lip which represents an interface for liquids of differing densities. The tubular liquid outlet includes a first tubular member and a second tubular member. A first end of the second tubular member telescopically mates with a first end of the first tubular member. A second end of the second tubular member serves as the top lip of the tubular liquid outlet. A threaded coupling is provided between the first tubular member and the second tubular member. Upon rotation of the second tubular member the relative telescopic position of the second tubular member and the first tubular member is altered. A fitting disposed in the interior bore of the tubular liquid outlet is non-rotatably coupled with the second tubular member. The fitting is adapted to receive a working end of a tool. A tool extended from exterior of the drum through the interior bore of the tubular liquid outlet is used to rotate the second tubular member. The rotation of the second tubular member alters the relative telescopic position of the first tubular member and the second tubular member to raise and lower the position of the top lip of the tubular liquid outlet which serves as the liquid interface.

4 Claims, 2 Drawing Sheets

EXTERNALLY ADJUSTABLE LIQUID INTERFACE FOR A CENTRIFUGAL SEPARATOR

FIELD OF THE INVENTION

The present invention relates to an externally adjustable liquid interface for a centrifugal separator.

BACKGROUND OF THE INVENTION

A centrifugal separator consists of a separation drum which is rotated at high speed. Liquids separate into zones within the drum due to their differing densities. An example of an application of centrifugal separation is in oil/water separation. Upon rotation of the centrifugal separator water migrates to the sides of the rotating drum while the lighter oil forms an oil zone which floats upon the water. In order for centrifugal separation to be attained a constant oil/water interface is required. With a constant oil/water interface, oil accumulations are skimmed from the surface of the water by passing from the drum through a spillway form of oil outlet. Any water which is "excess" to that required to maintain the interface is removed through a water outlet.

One of the most difficult aspects of centrifugal separation is achieving the constant interface between two liquids being separated. If a constant interface cannot be achieved, it is only a matter of time before one liquid starts flowing from the outlet intended for the other liquid. Each adjustment of the liquid interface takes hours as the centrifugal separator must be taken apart and alterations made to an interface assembly within the interior of the drum. The relative percentage of liquids varies widely, so considerable time and effort must be spent on interface adjustment each time the liquids being processed originate from a different source.

SUMMARY OF THE INVENTION

What is required is an externally adjustable liquid interface for a centrifugal separator.

According to the present invention there is provided an externally adjustable liquid interface for a centrifugal separator having a rotatably mounted drum with a circumferential sidewall. The externally adjustable liquid interface is characterized by a tubular liquid outlet extending into the drum. The tubular liquid outlet has an exterior surface, an interior bore, and a top lip which represents an interface for liquids of differing densities. The tubular liquid outlet includes a first tubular member having a first end, a second end and an interior bore. The first end extends into the drum and the second end is affixed to the sidewall of the drum. A second tubular member is provided having a first end, a second end and an interior bore. The first end of the second tubular member telescopically mates with the first end of the first tubular member, such that the interior bore of the second tubular member is co-axial with the interior bore of the first tubular member. The second end of the second tubular member serves as the top lip of the tubular liquid outlet. A threaded coupling is provided between the first tubular member and the second tubular member, such that upon rotation of the second tubular member the relative telescopic position of the second tubular member and the first tubular member is altered. A fitting disposed in the interior bore of the tubular liquid outlet is non-rotatably coupled with the second tubular member. The fitting is adapted to receive a working end of a tool, such that a tool extended from exterior of the drum through the interior bore of the tubular liquid outlet is used to rotate the second tubular member. The rotation of the second tubular member alters the relative telescopic position of the first tubular member and the second tubular member to raise and lower the position of the top lip of the tubular liquid outlet which serves as the liquid interface. A cap covers the top lip of the tubular liquid outlet. The cap has a top and an annular sidewall. A plurality of flow passages extend between the annular sidewall of the cap and exterior surface of the tubular liquid outlet whereby liquids communicate with the top lip. The top of the cap has a vent.

The adjustment mechanism as described, being externally adjustable, substantially reduces time required to adjust the liquid interface. The preferred form of threaded coupling includes a first transverse member extending transversely across the interior bore at the first end of the first tubular member, and a second transverse member extending transversely across the interior bore at the second end of the second tubular member. An internally threaded nut member is secured to the first transverse member and co-axially aligned with the first tubular member. An externally threaded bolt member is secured to the second transverse member, co-axially aligned with the second tubular member and matingly engaging the internally threaded nut member.

Although beneficial results may be obtained through the use of the externally adjustable liquid interface for a centrifugal separator, as described, it has been found that a vacuum tends to form at high rotational speeds which disrupts the liquid interface. Even more beneficial results may, therefore, be obtained when the tubular liquid outlet has a serpentine form liquid trap disposed in the interior bore.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
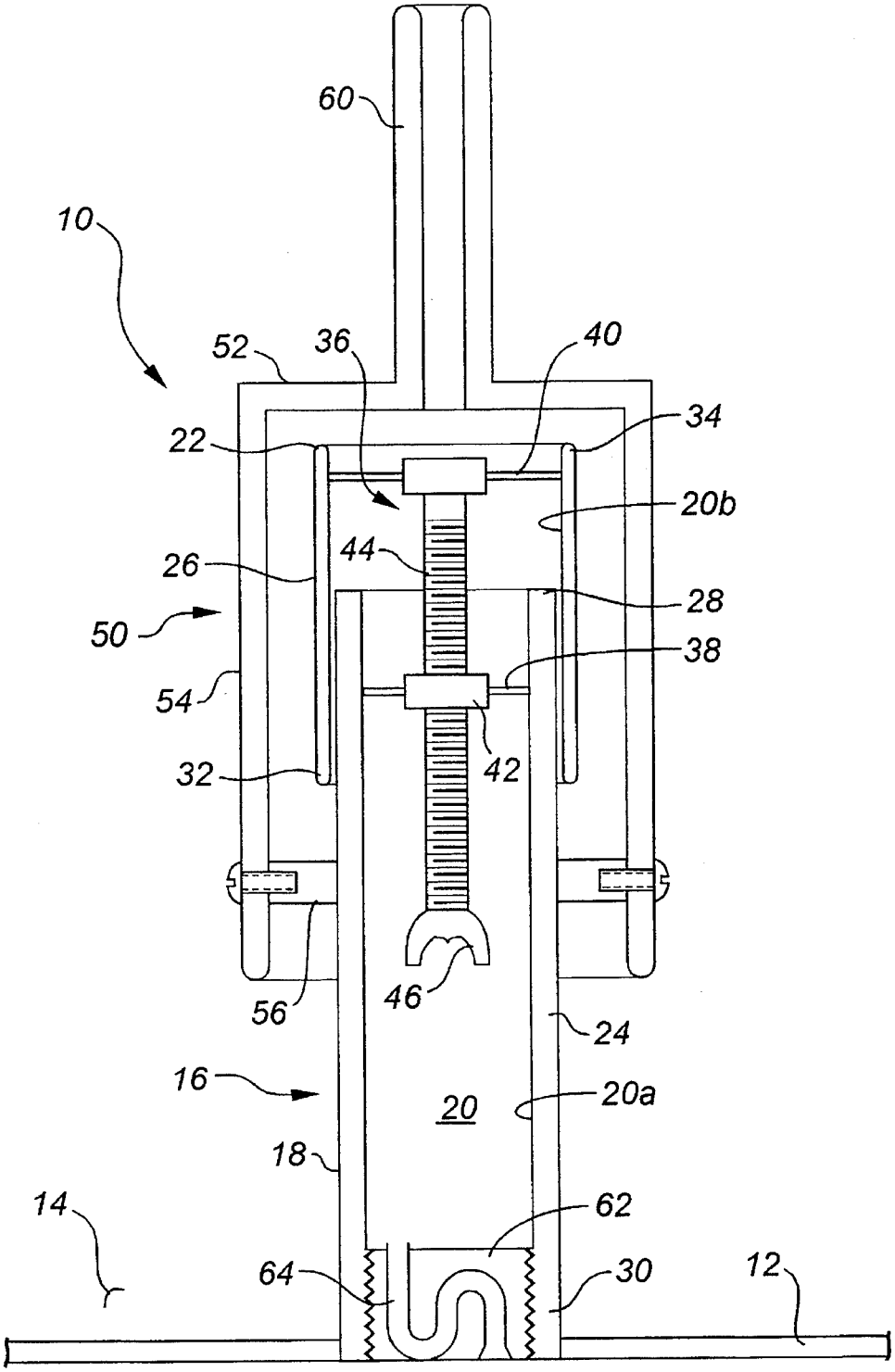
FIG. 1 is longitudinal section view of an externally adjustable liquid interface for a centrifugal separator constructed in accordance with the teachings of the present invention.

The preferred embodiment, an externally adjustable liquid interface for a centrifugal separator generally identified by reference numeral 10, will now be described with reference to FIGS. 1 and 2.

Figure 2:
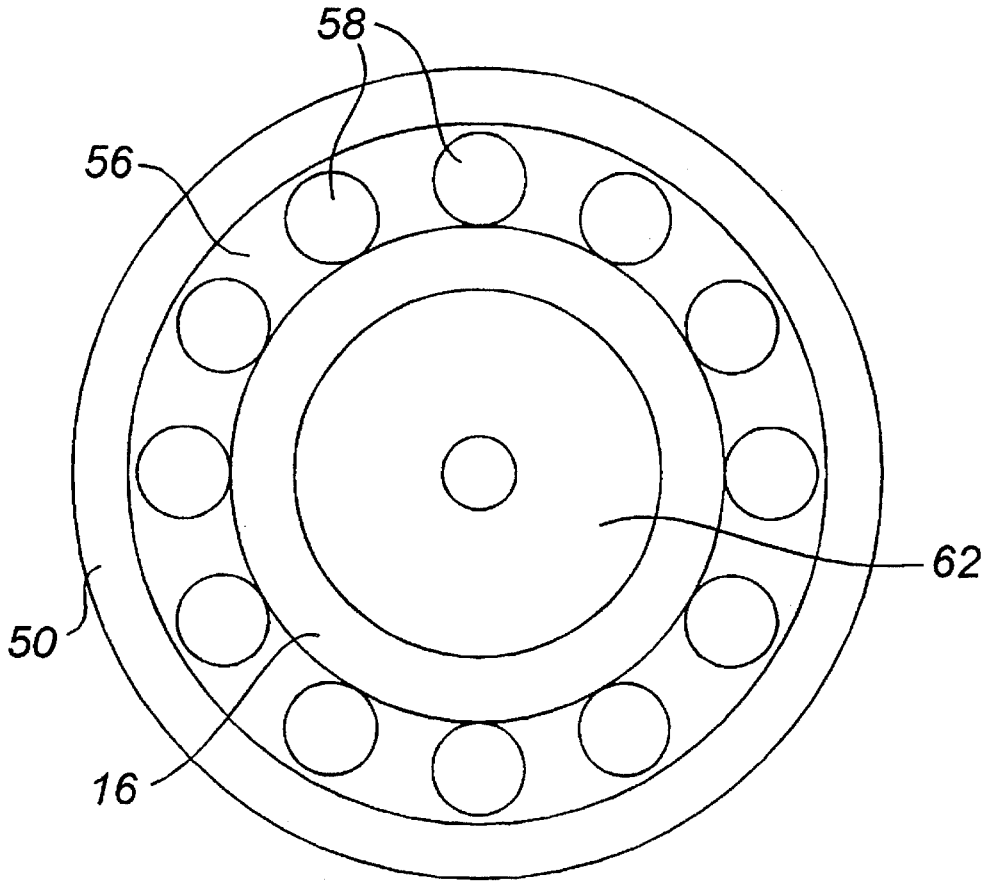
FIG. 2 is a bottom plan view of the externally adjustable liquid interface illustrated in FIG. 1.

Referring to FIG. 1, there is illustrated only a portion of a centrifugal separator. The portion illustrated is where externally adjustable interface assembly 10 extends through a sidewall 12 of a rotatably mounted drum 14. Externally adjustable interface assembly 10 includes a tubular liquid outlet, generally indicated by reference numeral 16, which extends through sidewall 12 into drum 14. Tubular liquid outlet 16 has an exterior surface 18, an interior bore 20, and a top lip 22. Top lip 22 represents an interface for liquids of differing densities, as will hereinafter be further described. Tubular liquid outlet 16 is constructed of two telescopically mating component sections; first tubular member 24 and second tubular member 26. First tubular member 24 has a first end 28, a second end 30 and an interior bore. In view of the fact that interior bore of first tubular member 24 is part of interior bore 20, it will be identified by reference numeral 20*a*. First end 28 of first tubular member 24 extends into drum 14. Second end 30 of first tubular member 24 is affixed to sidewall 12 of drum 14. Second tubular member 26 has a first end 32, a second end 34 and an interior bore. In view of the fact that interior bore of second tubular member 26 is part of interior bore 20, it will be identified by reference numeral 20*b*. First end 32 of second tubular member 26 telescopically mates with first end 28 of first tubular member 24. It will be understood that interior bore 20*b* of second tubular member 26 is co-axial with interior bore 20*a* of first tubular member 24. Second end 34 of second tubular member 26 serves as top lip 22 of tubular liquid outlet 16. Top lip 22 is a form of liquid spillway for the liquid interface, as will be hereinafter further described. A threaded coupling, generally identified by reference numeral 36, is provided between first tubular member 24 and second tubular member 26. The object of threaded coupling 36 is that rotation of second tubular member 26 will alter the relative telescopic position of second tubular member 26 and first tubular member 24. Referring to FIG. 1, the preferred construction of threaded coupling 36 includes a first transverse member 38 extending transversely across interior bore 20*a* at first end 28 of first tubular member 24. A second transverse member 40 extends transversely across interior bore 20*b* at second end 34 of second tubular member 26. An internally threaded nut member 42 is secured to first transverse member 38 in a position co-axially aligned with first tubular member 24. An externally threaded bolt member 44 is secured to second transverse member 40, co-axially aligned with second tubular member 26 and matingly engaging internally threaded nut member 42. A fitting 46 is positioned on a remote end 48 of externally threaded bolt 44. By means of externally threaded bolt 44 fitting 46 is non-rotatably coupled to second tubular member 26. A cap 50 covers top lip 22 of tubular liquid outlet 16. Cap 50 has a top 52 and an annular sidewall 54. Exterior surface 18 of tubular liquid outlet 16 has an annular cap mounting ring 56. Referring to FIG. 2, annular cap mounting ring 56 has a plurality of flow passages 58 whereby liquid passes between annular sidewall 54 of cap 50 and exterior surface 18 of tubular liquid outlet 16 to top lip 22. Top 52 of cap 50 has a substantially perpendicularly projecting vent tube 60. A flow restrictor 62 having a serpentine form liquid trap 64 is disposed in interior bore 20.

The use and operation of externally adjustable liquid interface assembly 10 will now be described with reference to FIGS. 1 and 2. Fitting 46 is adapted to receive a working end of a tool (not shown). Upon removal of flow restrictor 62 from interior bore 20 of tubular liquid outlet 16 a tool may be extended from exterior of drum 14 through interior bore 20 to engage fitting 46. Fitting 46 is non-rotatably coupled by means of externally threaded bolt 44 with second tubular member 26. By manipulating fitting 46 with a tool second tubular member 26 can be rotated thereby altering the relative telescopic position of first tubular member 24 and second tubular member 26. This has the effect of raising or lowering top lip 22 of tubular liquid outlet 16. The adjustment mechanism is simple in operation. Internally threaded nut member 42 is secured to first transverse member 38 which in turn is secured to first tubular member 24. Externally threaded bolt member 44 is secured to second transverse member 40 which in turn is secured to second tubular member 26. Adjustment is effected by rotating externally threaded bolt member 44 through fitting 46. The rotation of externally threaded bolt member 44 results in rotation of second tubular member 26. It will be appreciated by one skilled in that art that the raising or lowering of top lip 22 alters the liquid interface for top lip 22 serves as a liquid spillway. When in operation the water level in drum 14 rises to the level of top lip 22. A layer of oil floats on the water. The presence of cap 50 prevents oil from being drawn through tubular liquid outlet 16. The role of tubular liquid outlet 16 is to remove excess water from drum 14. In order to ensure that no oil is removed with the excess water, the flow of liquid comes from below cap 50, passing through flow passages 58 and up between annular sidewall 54 of cap 50 and exterior surface 18 of tubular liquid outlet 16 to top lip 22. The presence of vent tube 60 prevents a vacuum from developing which adversely effects the interface. In high rotational speed applications it has been found that additional measures are required to prevent a vacuum from forming which may adversely effect the interface. Serpentine form liquid trap 64 operates in the same manner as a trap in a toilet. Liquids can flow through liquid trap 64, but air is prevented from passing therethrough. Flow restrictor 62 contains liquid trap 64 and has an orifice size to meet the anticipated flow requirements.

It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. An externally adjustable liquid interface for a centrifugal separator having a rotatably mounted drum with a circumferential sidewall, characterized by:

a. a tubular liquid outlet extending into the drum, the outlet having an exterior surface, an interior bore, and a top lip which represents an interface for liquids of differing densities, the tubular liquid outlet comprising:

i. a first tubular member having a first end, a second end and an interior bore, the first end extending into the drum and the second end affixed to the sidewall of the drum;

ii. a second tubular member having a first end, a second end and an interior bore, the first end of the second tubular member telescopically mating with the first end of the first tubular member, such that the interior bore of the second tubular member is co-axial with the interior bore of the first tubular member, the second end of the second tubular member serving as the top lip of the tubular liquid outlet;

iii. a threaded coupling between the first tubular member and the second tubular member, such that upon rotation of the second tubular member the relative telescopic position of the second tubular member and the first tubular member is altered; and iv. a fitting disposed in the interior bore of the tubular liquid outlet and non-rotatably coupled with the second tubular member and adapted to receive a working end of a tool, such that a tool extended from exterior of the drum through the interior bore of the tubular liquid outlet can be used to rotate the second tubular member thereby altering the relative telescopic position of the first tubular member and the second tubular member to raise and lower the position of the top lip of the tubular liquid outlet which serves as the liquid interface; and b. a cap covering the top lip of the tubular liquid outlet, the cap having a top and an annular sidewall, a plurality of flow passages extending between the annular sidewall of the cap and the tubular liquid outlet whereby liquid communicates with the top lip, the top of the cap having a vent.

2. The externally adjustable liquid interface for a centrifugal separator as defined in claim 1, the tubular liquid outlet having a serpentine form liquid trap disposed in the interior bore.

3. The externally adjustable liquid interface for a centrifugal separator as defined in claim 1, the threaded coupling comprising a first transverse member extending transversely across the interior bore at the first end of the first tubular member, a second transverse member extending transversely across the interior bore at the second end of the second tubular member, an internally threaded nut member secured to the first transverse member and co-axially aligned with the first tubular member, an externally threaded bolt member secured to the second transverse member, co-axially aligned with the second tubular member and matingly engaging the internally threaded nut member.

4. An externally adjustable liquid interface for a centrifugal separator having a rotatably mounted drum with a circumferential sidewall, characterized by:

a. a tubular liquid outlet extending into the drum, the outlet having an exterior surface, an interior bore, and a top lip which represents an interface for liquids of differing densities, the tubular liquid outlet comprising:

i. a first tubular member having a first end, a second end and an interior bore, the first end extending into the drum and the second end affixed to the sidewall of the drum;

ii. a second tubular member having a first end, a second end and an interior bore, the first end of the second tubular member telescopically mating with the first end of the first tubular member, such that the interior bore of the second tubular member is co-axial with the interior bore of the first tubular member, the second end of the second tubular member serving as the top lip of the tubular liquid outlet;

iii. a threaded coupling between the first tubular member and the second tubular member, such that upon rotation of the second tubular member the relative telescopic position of the second tubular member and the first tubular member is altered, the threaded coupling comprising:

(1) a first transverse member extending transversely across the interior bore at the first end of the first tubular member;

(2) a second transverse member extending transversely across the interior bore at the second end of the second tubular member;

(3) an internally threaded nut member secured to the first transverse member and co-axially aligned with the first tubular member; and (4) an externally threaded bolt member secured to the second transverse member, co-axially aligned with the second tubular member and matingly engaging the internally threaded nut member; and iv. a fitting positioned on a remote end of the externally threaded bolt member whereby the fitting is non-rotatably coupled to the second tubular member, the fitting being adapted to receive a working end of a tool, such that a tool extended from exterior of the drum through the interior bore of the tubular liquid outlet can be used to rotate the second tubular member thereby altering the relative telescopic position of the first tubular member and the second tubular member to raise and lower the position of the top lip of the tubular liquid outlet which serves as the liquid interface;

b. a cap covering the top lip of the tubular liquid outlet, the cap having a top and an annular sidewall, the exterior surface of the tubular liquid outlet having an annular cap mounting ring with a plurality of flow passages whereby liquid passes between the annular sidewall of the cap and the tubular liquid outlet to the top lip, the top of the cap having a substantially perpendicularly projecting vent tube; and c. a serpentine form liquid trap disposed in the interior bore.

* * * * *